United States Patent [19]

Billings

[11] Patent Number: 4,704,652

[45] Date of Patent: Nov. 3, 1987

[54] HYBRID ELECTRICAL POWER CONTROLLER

[75] Inventor: William W. Billings, Lima, Ohio

[73] Assignee: Westinghouse Electric Corp., Pittsburgh, Pa.

[21] Appl. No.: 822,715

[22] Filed: Jan. 27, 1986

[51] Int. Cl.[4] ..... H01H 33/59

[52] U.S. Cl. ..... 361/5; 361/13; 361/6; 361/8

[58] Field of Search ..... 361/3, 5, 6, 8, 9, 13, 361/58, 154, 56, 156, 152; 307/134

[56] References Cited

U.S. PATENT DOCUMENTS

| | | | |
|---|---|---|---|
| 3,558,910 | 1/1971 | Dale et al. | 361/13 X |
| 4,392,171 | 7/1983 | Kornrumpf | 361/13 X |
| 4,420,784 | 12/1983 | Chen et al. | 361/7 |

FOREIGN PATENT DOCUMENTS

| | | |
|---|---|---|
| 924281 | 4/1963 | United Kingdom . |
| 2069243 | 8/1981 | United Kingdom . |
| 1304158 | 1/1983 | United Kingdom . |

*Primary Examiner*—A. D. Pellinen
*Assistant Examiner*—Todd E. DeBoer
*Attorney, Agent, or Firm*—R. P. Lenart

[57] ABSTRACT

A hybrid electrical power controller is provided with a relay having a coil and a pair of mechanical contacts. A solid state switching device is electrically connected in parallel with the mechanical contacts and the parallel combination of that switching device and the contacts is connected between an input and an output terminal. A relay coil energizing circuit is included and means is provided for producing a signal representative of current flowing in the relay coil following deenergization of the relay coil. A solid state switching device control circuit responds to this signal and turns off the switching device when the signals fall below a predetermined magnitude.

4 Claims, 4 Drawing Figures

HYBRID ELECTRICAL POWER CONTROLLER

BACKGROUND OF THE INVENTION

This invention relates to electrical switching devices and more particularly to power controllers which include both mechanical contacts and solid state switching devices connected in parallel with each other.

Switching devices for use in aircraft electrical systems must be designed to minimize size and weight while at the same time minimizing power dissipation and switching transients. Electromechanical relays offer the advantage of providing high current switching with minimum power dissipation in the steady state, that is, when the relay is on and the contacts are closed. Solid state switching devices which are commonly referred to as solid state power controllers, solid state circuit breakers, or solid state switches offer the advantages of fast switching times and reduced switching transients. However, solid state switching devices have the disadvantage that they typically include a voltage drop which results in a power dissipation of about one watt per amp per pole. For example, one 2-pole, 12.5 amp solid state power controller has a rated power dissipation of 34 watts (including 26.5 watts switch loss and 7.5 watts control power) compared to a 5.5-watt power dissipation for a comparable mechanical circuit breaker. The resulting heat dissipation is a significant disadvantage that can preclude the use of solid state power controllers for many applications, especially for higher current ratings and for replacement of mechanical circuit breakers in existing equipment designs. It is therefore desirable to construct a hybrid power controller which includes both solid state and mechanical switching elements and utilizes the advantages of both.

SUMMARY OF THE INVENTION

The present invention seeks to provide a hybrid power controller which utilizes the parallel combination of mechanical relay contacts and solid state switching devices to provide the advantages of precise solid state control and the low relay contact drop of the mechanical contacts to reduce the switch voltage and its associated power dissipation. Some of the features provided by hybrid power controllers constructed in accordance with this invention include:

a low switch drop, that is, less than that of equivalently rated circuit breakers with a series overload trip coil;

full cycle, zero crossover turn-on and turn-off to minimize in-rush transients;

fast overcurrent trip times of one cycle or faster to minimize fault energy with heavy overloads;

a simple means of relay contact position sensing; and efficient pulse width modulated relay coil energization to simplify power supply design.

To achieve these performance features, an electrical power controller constructed in accordance with this invention comprises a relay, having a coil and a pair of mechanical contacts, and a solid state switching device electrically connected in parallel with the contacts. The parallel combination of the solid state switching device and the mechanical contacts is connected between an input terminal and an output terminal. The controller further includes means for energizing the relay coil and means for producing a signal representative of current flowing in the relay coil following deenergization of the relay coil. Means are also provided for controlling the operation of the solid state switching device in response to that signal and to turn off the solid state switching device when that signal falls below a predetermined magnitude.

This invention also encompasses a method of controlling electrical power which comprises the steps of:

supplying electrical power to an input terminal of a hybrid power controller;

turning on a solid state switching device connected between the input terminal and an output terminal to deliver power to a load;

supplying electric current to a coil of a relay to close a pair of mechanical contacts, which are electrically connected in parallel with the solid state switching device;

discontinuing the supply of electric current to the coil;

producing a signal representative of current flowing in the coil following the discontinuance of the supply of electric current to the coil; and turning off the solid state switching device when that signal falls below a predetermined magnitude.

DESCRIPTION OF THE PREFERRED EMBODIMENT

Figure 1:
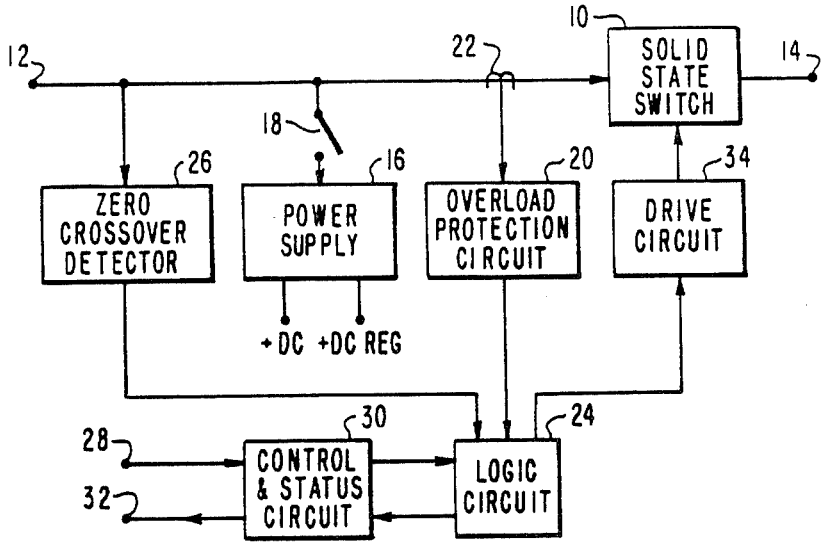
PRIOR ART FIG. 1
FIG. 1 is a block diagram of a prior art solid state power controller.

In order to efficiently describe the preferred embodiment of the present invention, it is instructive to first refer to the prior art solid state power controller of FIG. 1. The functional block diagram of FIG. 1 shows a solid state switch 10, which may be for example an SCR or transistor-diode network, connected between an input terminal 12, for connection to a power source, and an output terminal 14, for connection to a load. A power supply 16 receives power from the input terminal 12 when control switch 18 is closed and provides two levels of direct voltage. A +DC voltage is provided to power the solid state switch drive circuitry and a +DC Reg voltage is provided to power the low level logic electronics. The control switch 18 serves as an ON/OFF control for the solid state power controller by energizing and deenergizing the power supply in the respective ON/OFF states.

An overload protection circuit 20 senses load current by means of current transformer 22 and provides a trip signal to the control logic circuit 24 if an overload condition occurs and persists for a time exceeding the circuit's current-time trip threshold. A zero crossover detector circuit 26 provides synchronization pulses to the logic circuit 24 that are used to gate the solid state power controller turn-on and turn-off signals at instants when the power source voltage crosses zero. For full cycle control, only one zero crossover point, for example at 0° or at 180°, is used.

In lieu of using the control switch 18 as means for controlling the ON/OFF states of the solid state power controller, a separate control signal may be used by way of control input terminal 28. That input terminal is connected to a control and status circuit 30 which also provides an output signal by way of status terminal 32 that indicates the operational state of the solid state power controller. This status output signal may indicate such conditions as on, off, tripped, component failure or combinations of these conditions. The logic circuit 24 has inputs from the control and status circuit, zero crossover circuit and overload protection circuit from which it provides output signals to a drive circuit 34 and the control and status circuit 30. The drive circuit 34 amplifies the logic circuit control signal and causes the solid state switch to turn on. This drive circuit may also provide isolation between the logic circuit and the solid state switch by means of various known isolation interfaces.

Figure 2:
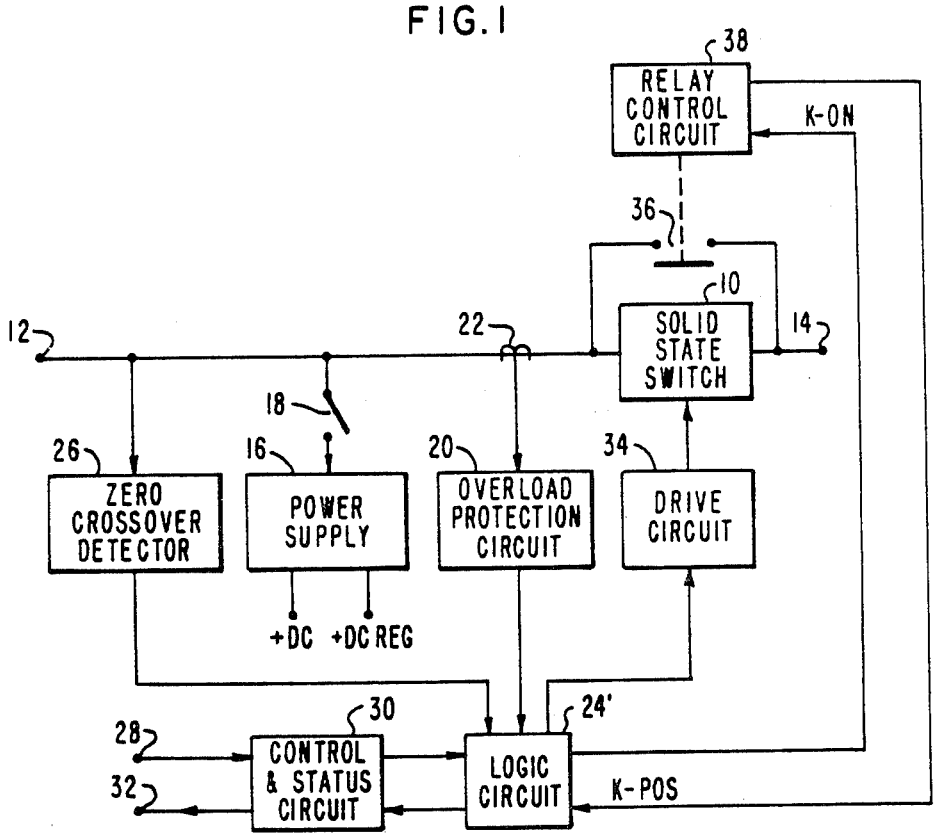
FIG. 2 is a block diagram of a hybrid power controller constructed in accordance with one embodiment of the present invention.

FIGS. 2 is a functional block diagram of a low-loss hybrid power controller constructed in accordance with the present invention. It will be apparent that this power controller includes the features of the prior art solid state power controller of FIG. 1 and further includes a relay having a pair of mechanical contacts 36 electrically connected in parallel with the solid state switch 10; a relay control 38; and a modified logic circuit 24' which includes means for interfacing with the relay control circuit. The mechanical relay contacts 36 provide a low voltage drop path for load current whenever the hybrid power controller is on, except for transitional conditions occurring during opening and closing of the power controller. The relay control circuit 38 includes a relay coil and operates in response to a K-ON signal from the logic circuit 24'. The relay control circuit also provides a relay position indicating signal K-POS to the logic circuit 24' for coordination of the solid state switch operation with the operation of the relay.

Figure 3:
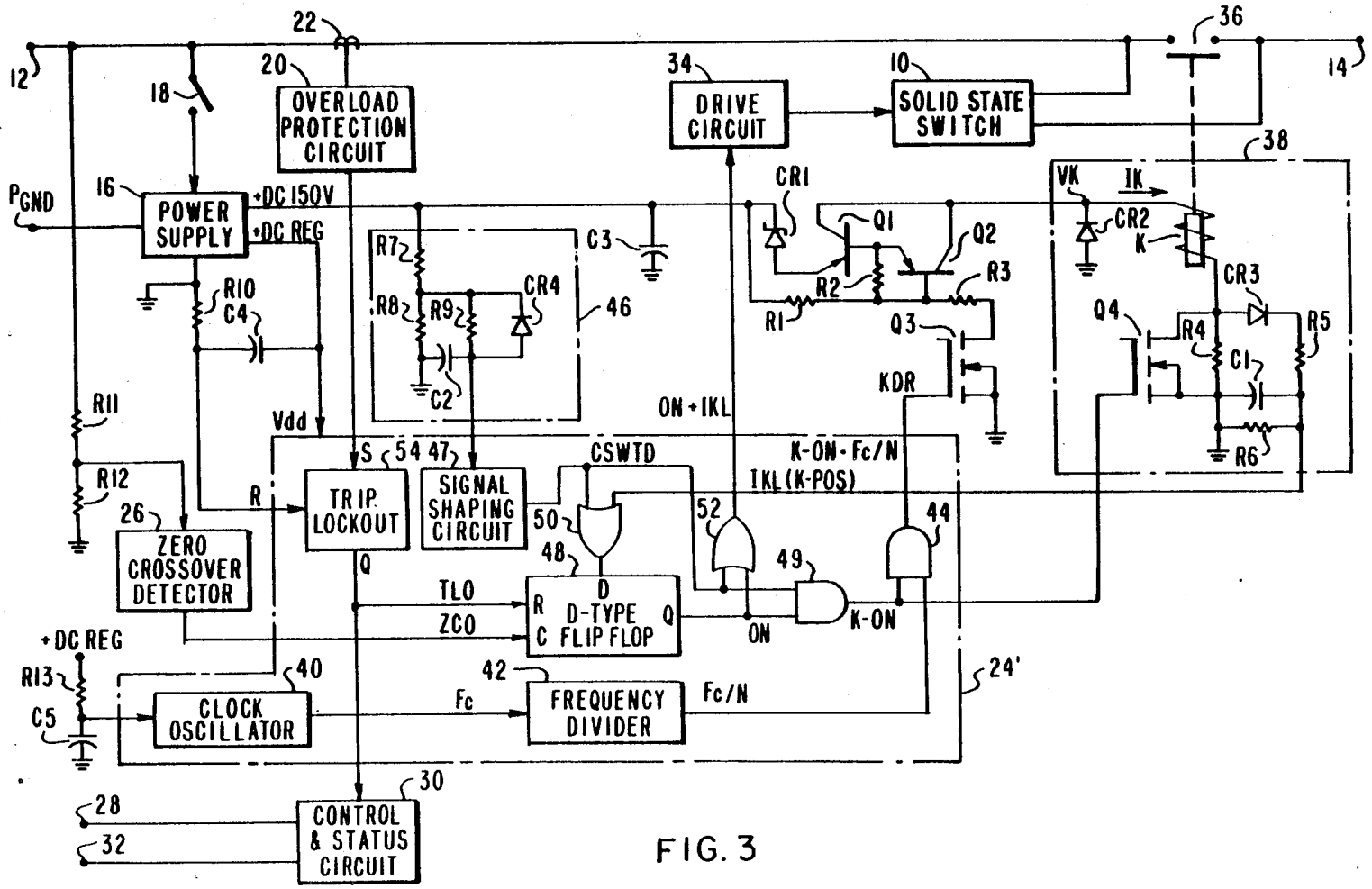
FIG. 3 is a schematic diagram, partially in block diagram form, of a hybrid power controller constructed in accordance with FIG. 2.

FIG. 3 is a schematic diagram of a hybrid power controller constructed in accordance with FIG. 2, with functional blocks used for circuit elements which are known in the prior art. Therefore, the following description is primarily concerned with the logic and relay control circuits which are unique to this invention and provide the control and synchronization of the operation of the solid state switch and relay contacts at turn-on, turn-off and overload trip-off.

When considering the means for energizing the relay coil K, it is desirable to use a DC-type relay coil to provide for fast opening times and to be able to use a variety of coil voltage ratings for optimum selection based on the required solid state power controller circuitry, voltages, costs, etc. When the power controller is used on a 115 volts rms power system, a 150-volt DC filtered power supply can be easily obtained by full-wave rectification and peak filtering of the power source voltage. Adaptation of this 150 volts DC to the relay coil rated voltage would be impractical by series regulation since one of the objectives of the present invention is to reduce power dissipation. However, by using pulse width modulation of the 150-volt DC supply and by varying the duty cycle, a variety of average DC voltages can be provided for the relay. Furthermore, since the relay coil contains inductance, the coil itself can provide filtering to maintain continuous relay coil current with proper utilization of the relay L/R time constant along with the selected pulse frequency and pulse width.

This is accomplished in the FIG. 3 circuit wherein the relay coil K is energized by a Darlington configuration pulse width modulation switch which pulses the relay coil with 150-volt DC pulses in the hybrid power controller ON state. The frequency of the pulses is determined by a clock oscillator 40 which delivers a logic signal having a frequency Fc to a frequency divider circuit 42 which divides that frequency by a preselected number N. The resulting signal has a duration of N/Fc and a frequency of Fc/N. Typical values of Fc may range from, for example, 1 to 10 kilohertz and typical values for N may range from, for example, 4 to 8 with relay coils having voltage ratings of 26 volts DC and 48 volts DC.

The logic signal produced by frequency divider 42 is combined in AND gate 44 with a relay ON signal K-ON to produce a relay drive signal KDR when the hybrid power controller is in the ON state and the relay is energized. Transistor Q3 receives the relay drive signal KDR and in turn provides a base drive signal for the Q1–Q2 pulse width modulation switch to energize the relay coil K with 150-volt DC peak pulses.

The K-ON signal also provides transistor Q4 with a gate signal, causing Q4 conduction and clamping by resistor R4 whenever the hybrid power controller is in the ON state. However, when the hybrid power controller is either turned off or tripped off, the gate signals to transistors Q3 and Q4 are removed simultaneously, causing deenergization of the relay coil K. A shunt diode is usually connected across a relay coil such that current resulting from the collapse of the coil magnetic field following deenergization flows through the shunt diode. This continued current flow delays the opening of the relay contacts. When transistor Q4 in FIG. 3 is turned off, resistor R4 is inserted into the relay coil circuit, and diode CR2 serves as the shunt diode. Consequently, a fast decay of the relay coil current IK occurs at a rate determined by the coil inductance and the circuit resistance with a time constant which is proportional to LK/(RK+R4), where LK is the relay coil inductance and RK is the coil resistance. Without the Q4–R4 fast dropout circuit, typical relay dropout times, in one prototype circuit, were about 5 milliseconds. Using a 5.1 kilo-ohm resistor for R4, this time was reduced to approximately 1.0 to 1.5 milliseconds, which is significant since it allows the hybrid power controller to trip off within a one-cycle time duration for a 400 hertz supply if a heavy overload condition occurs.

When the relay coil K is deenergized, a collapsing magnetic field within the coil causes current to continue to flow and results in an inductively induced voltage that occurs across resistor R4 upon relay opening. This inductively induced voltage initially rises very fast to a high peak voltage and then decays toward zero. The current decay rate is modified when the relay armature starts to move to open the contacts, thereby causing a second peak or humping of the current through, and hence the voltage across, R4 so that a threshold voltage level detection method can be used to sense when the R4 voltage level has decayed below and beyond the point of relay contact opening so as to initiate opening of the solid state switch 10 to complete the hybrid power controller turn-off operation. The voltage across resistor R4 is therefore used to obtain a relay contact position indicating signal K-POS without the need for less reliable contact position indicating devices. The network comprising diode CR3, resistors R5 and R6 and capacitor C1 provides the necessary voltage stepdown, isolation and filtering for the R4 voltage signal to be used in the low level logic devices of the logic control circuit 24'.

Figure 4:
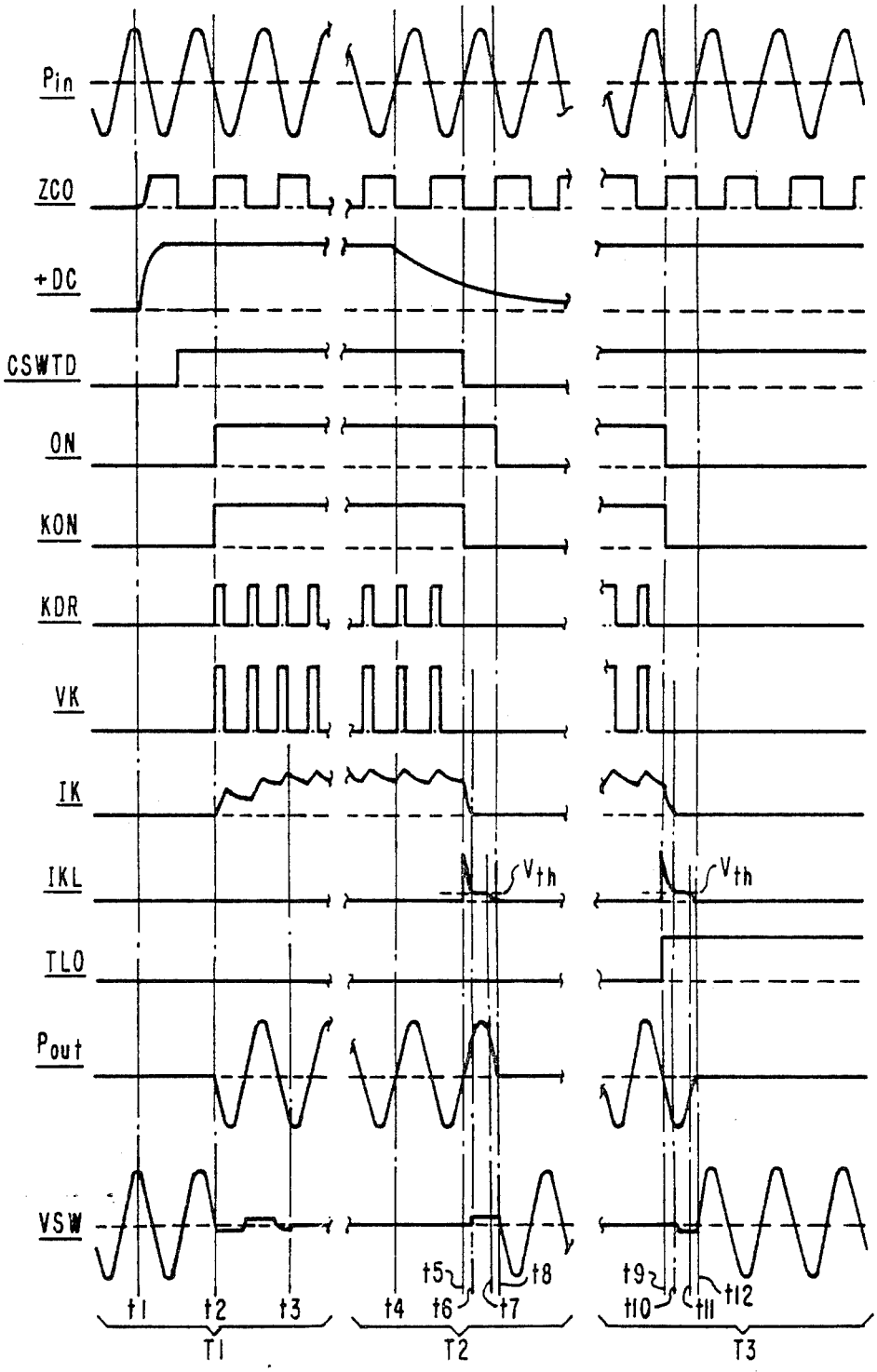
FIG. 4 is a series of waveforms illustrating the operation of the circuit of FIG. 3.

Reference can now be made to the waveforms of FIG. 4 in combination with the circuit of FIG. 3 to describe the operation of the hybrid power controller. FIG. 4 contains three columns of waveforms designated as applying to time intervals T1, T2 and T3. Time interval T1 includes waveforms which depict the turn-on operation of the hybrid power controller. Waveform $P_{in}$ represents the input power delivered to terminal 12. At time t1, the control switch 18 closes thereby energizing power supply 16. As a result, the power supply output voltage +DC builds up and synchronization pulses ZCO from the zero crossover circuit 26 appear. The positive rising edges of the ZCO pulses occur precisely at the negative slope crossing points of the input power waveform. After a short time delay caused by circuit 46, a control switch time delay signal CSWTD appears at the output of signal shaping circuit 47 and allows for power supply buildup only after any contact bounce in control switch 18 has disappeared. The signal shaping circuit 47 ensures that the delay signal CSWTD includes rapid voltage transitions. The ON signal appears subsequently with the next positive-going ZCO voltage pulse at the time t2 by the clocking of the D-type flip-flop 48. Then the K-ON signal appears at the output of AND gate 49. Therefore, at time t2, the drive circuit is energized, causing the solid state switch 10 to conduct thereby applying the input voltage $P_{in}$ to the output terminal 14; and the relay coil K is energized with pulse width modulated voltage VK by the gating of the Fc/N and the K-ON signals through AND gate 44 to provide the relay drive signal KDR. It should be noted that the time scale for the VK, KDR and IK signals in FIG. 4 would actually be much faster than illustrated. However, a slower time scale has been selected to better illustrate the waveform details.

FIG. 4 shows that the relay coil current IK is a continuous current even though energized by a pulse width modulated voltage since filtering action is provided by the relay coil inductance. At time t3, the relay contacts 36 close, thereby shorting the solid state switch 10 so that the load current is now entirely conducted through the relay contacts, thereby resulting in a very low switch voltage drop and power dissipation. Although the solid state switch is not carrying current at this time, it is left energized in the ON state so that if relay contact bounce, for example, due to vibration or shock, occurs, the load voltage will not be interrupted.

The time interval T2 in FIG. 4 illustrates a turn-off operation of the hybrid power controller. At time t4, the control switch 18 opens to initiate turn-off, thereby causing the power supply 16 to be de-energized such that its output voltage +DC decays. As a result of time delay circuit 46, the control switch time delay signal CSWTD which was also initiated prior to time t4, elapses at time t5, thereby causing immediate removal of the KDR and VK signals. The removal of the K-ON signal at time t5 turns off transistor Q4 and unclamps resistor R4 so that resistor R4 is now inserted in series with the relay coil K. Since R4 has a relatively high resistance value compared to the relay coil resistance, a very rapid dissipation of relay coil energy results with subsequent fast decay of the relay coil current and opening of the relay contacts. As described previously, the voltage pulse generated across R4 provides a signal, IKL, indicating relay contact position as it opens. This signal initially peaks rapidly, decays and then humps as the relay opens at time t6, and then finally decays to zero. As long as the IKL signal voltage exceeds a threshold level, $T_{th}$, an input signal is maintained by OR gate 50 at the D input of flip-flop 48 so that the ON output signal of flip-flop 48 keeps the output of OR gate 52 high, thereby keeping the solid state switch 10 energized. When the IKL signal decays below the $V_{th}$ level, at time t7, the D input signal on flip-flop 48 is removed. Subsequently, at the next positive-going ZCO pulse, at time t8, flip-flop 48 toggles off, thereby deenergizing the solid state switch and disconnecting the load from the power source. Thus, synchronous zero crossover turn-off has been provided.

The waveforms of time interval T3 in FIG. 4 illustrate a trip-off operation of the hybrid power controller. The waveforms are similar to those which illustrate the turn-off function in time interval T2 with the exception that an output signal TLO from the trip lockout circuit 54 causes the opening of the hybrid power controller and that full cycle control is not provided. When the trip lockout signal TLO occurs, in response to an overcurrent trip signal from overload protection circuit 20, at time t9, instantaneously the ON, K-ON, KDR and VK signals go to zero and relay opening is initiated. Once again, the relay current signal IKL humps at time t10 as the relay armature moves and subsequently falls below the $V_{th}$ voltage level at time t11, indicating that the relay has opened. The power switch drive signal occurring at the output of OR gate 52 is then instantaneously removed. If silicon-controlled rectifiers have been used for the solid state switch 10, shut off will occur at the next zero crossing by natural commutation of the SCRs as illustrated at time t12. If transistors are used for the solid state switch, load current interruption will occur at time t11 when the drive signal at the output of OR gate 52 is removed. Consequently, rapid hybrid power controller load current interruption occurs in response to an overcurrent fault signal without full cycle control so that faster trip times may be provided to limit heavy overload current durations.

Both single pole 1 amp, 115 volts rms, 400 hertz and 2-pole 7 amp, 115 volts rms, 400 hertz power controllers have been constructed in accordance with this invention. The 1-amp version has exhibited $\frac{1}{2}$ cycle interruption time when closing into a fault and $\frac{3}{4}$ cycle interruption time when a fault was applied to the controller while in the ON state. In addition, lower switch voltage drops than obtainable with the equivalent-rated electromechanical circuit breakers (which have a series current coil for circuit breakers rated from 1 to 12.5 amps) have been obtained. Furthermore, reductions in power controller dissipation ranging from 50% for the 1-amp rating to 70% for a 12.5-amp rating have been demonstrated.

In order to provide a more complete description of the circuit of FIG. 3, Table I illustrates the component values used to construct a hybrid power controller in accordance with this invention.

TABLE I

| Item | Type |
|---|---|
| Q1 | 2N6212 |
| Q2 | MPSA93 |
| Q3 | ZVN0545B |
| Q4 | ZVN0545B |
| CR1 | 5.1 V |
| CR2 | 1N649 |
| CR3 | 1N4146 |

TABLE I-continued

| Item | Type |
|---|---|
| CR4 | 1N4146 |
| C1 | 0.01 μfd |
| C2 | 0.068 μfd |
| C3 | 4.0 μfd |
| C4 | 0.068 μfd |
| C5 | 220 pfd |
| R1 | 22KΩ |
| R2 | 5.1KΩ |
| R3 | 51KΩ |
| R4 | 5.1KΩ |
| R5 | 100KΩ |
| R6 | 13KΩ |
| R7 | 51KΩ |
| R8 | 6.2KΩ |
| R9 | 100KΩ |
| R10 | 100KΩ |
| R11 | 249KΩ |
| R12 | 64.9KΩ |
| R13 | 100KΩ |
| K | Babcock BR19-S662 |

It should therefore be apparent that the hybrid power controllers of the present invention operate in accordance with a method of controlling electrical power which comprises the steps of:

supplying electrical power to an input terminal of a hybrid power controller;

turning on a solid state switching device connected between the input terminal and an output terminal to deliver power to a load;

supplying electric current to a coil of a relay to close a pair of mechanical contacts, which are electrically connected in parallel with the solid state switching device;

disconnecting the supply of electric current to the coil;

producing a signal representative of current flowing in the coil following the step of discontinuing the supplying of electric current to the coil; and turning off the solid state switching device when that signal falls below a predetermined magnitude.

In the preferred embodiment, that signal is produced by inserting a resistor in series with the relay coil when power to the relay coil is discontinued. The signal is then formed by the decaying voltage waveform across the resistor caused by current circulating in a loop containing the coil, the resistor and a diode. This voltage waveform is used for the purpose of determining when the relay contacts have opened so that turn-off of the solid state switching device can be initiated. In the preferred embodiment, relay coil inductance is used to filter a pulse width modulated driving voltage for circuit efficiency, flexibility and economy. The resulting circuit therefore exhibits fast opening times to within one cycle in order to limit heavy fault energy flow; synchronized zero crossover turn-on and turn-off with coordinated actuation of the solid state switch and the relay contacts; and low switch drop and therefore low dissipation in normal operation.

Although the present invention has been described in terms of what is at present believed to be its preferred embodiment, it will be apparent to those skilled in the art that various changes may be made without departing from the scope of the invention. For example, the present invention is also applicable to multiple pole power controllers which are used in AC circuits of various frequencies or for DC applications. It is therefore intended that the appended claims cover such modifications.

What is claimed is:

1. An electrical power controller comprising:

an input terminal for connection to a power source;

an output terminal for connection to a load;

a relay having a coil and a pair of mechanical contacts, said contacts being electrically connected between said input terminal and said output terminal;

a first solid state switching device electrically connected in parallel with said mechanical contacts;

means for energizing said relay coil;

a resistor electrically connected in series with said relay coil for producing a first signal representative of current flowing in said relay coil following de-energization of said relay coil;

a second solid state switching device, having a main conduction path electrically connected in parallel with said resistor; and means for controlling the operation of said first solid state switching device, said means for controlling being responsive to said signal to turn off said first switching device when said signal falls below a predetermined magnitude.

2. An electrical power controller as recited in claim 1, wherein said means for energizing comprises:

means for supplying pulse width modulated DC voltage pulses to said relay coil.

3. An electrical power controller as recited in claim 1, further comprising:

a diode electrically connected in parallel with the series connection of said resistor and said coil.

4. An electrical power controller as recited in claim 1, wherein said means for controlling comprises:

means combining an ON signal with said first signal representative of current flowing in said relay coil, such that said first solid state switching device is turned ON as long as either said ON signal is at a first logic level or said first signal is above a threshold level.

* * * * *